US008043447B2

(12) United States Patent
Hoshino et al.

(10) Patent No.: US 8,043,447 B2
(45) Date of Patent: Oct. 25, 2011

(54) METHOD OF MANUFACTURING HIGH TENSILE STRENGTH THICK STEEL PLATE

(75) Inventors: Manabu Hoshino, Tokyo (JP); Masaaki Fujioka, Tokyo (JP); Yoichi Tanaka, Tokyo (JP); Masanori Minagawa, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/450,997

(22) PCT Filed: Mar. 31, 2009

(86) PCT No.: PCT/JP2009/056664

§ 371 (c)(1),
(2), (4) Date: Jan. 5, 2010

(87) PCT Pub. No.: WO2009/123195

PCT Pub. Date: Oct. 8, 2009

(65) Prior Publication Data

US 2010/0108202 A1 May 6, 2010

(30) Foreign Application Priority Data

Apr. 1, 2008 (JP) ..... 2008-095021
Mar. 13, 2009 (JP) ..... 2009-061630

(51) Int. Cl.
*C21D 8/00* (2006.01)

(52) U.S. Cl. ..... 148/654; 148/505; 148/506; 148/661

(58) Field of Classification Search ..... 148/654
See application file for complete search history.

(56) References Cited

FOREIGN PATENT DOCUMENTS

| | | |
|---|---|---|
| JP | 3-232923 | 10/1991 |
| JP | 08-188823 | 7/1996 |
| JP | 9-263828 | 10/1997 |
| JP | 2000-160281 | 6/2000 |
| JP | 2000-319726 | 11/2000 |
| JP | 2001-226740 | 8/2001 |
| JP | 2004-052063 | 2/2004 |
| JP | 2005-15859 | 1/2005 |
| JP | 2006-342421 | 12/2006 |
| JP | 2007-277622 | 10/2007 |
| JP | 2007277623 A * | 10/2007 |

OTHER PUBLICATIONS

Machine translation of JP 2004-052063.*
Machine translation of JP 2006-342421.*
Nippon Steel Technical Report No. 348 (1993), p. 10-16 and English Translation.
Nippon Steel Technical Report No. 348 (1993), p. 10-16 and English Translation p. 2.
International Search Report dated Jul. 21, 2009 issued in corresponding PCT Application No. PCT/JP2009/056664.
European Search Report dated Jul. 8, 2011 issued in corresponding European Application No. 09 72 8671.

* cited by examiner

*Primary Examiner* — Roy King
*Assistant Examiner* — Christopher Kessler
(74) *Attorney, Agent, or Firm* — Kenyon & Kenyon LLP

(57) ABSTRACT

In a method of manufacturing a high tensile strength thick steel plate, a steel slab contains 0.03-0.055% of C, 3.0-3.5% of Mn, and 0.002-0.10% of Al, the amount of Mo is limited to 0.03% or less, the amount of Si is limited to 0.09% or less, the amount of V is limited to 0.01% or less, the amount of Ti is limited to 0.003% or less, the amount of B is limited to 0.0003% or less, and of which Pcm value representing a weld cracking parameter is fallen within the range of 0.20-0.24% and DI value representing a hardenability index is fallen within the range of 1.00-2.60, is heated to 950-1100° C. The steel slab is subjected to a rolling process with a cumulative draft of 70-90% when a temperature is in a range of 850° C. or more, and then, the steel slab is subjected to a rolling process at 780° C. or higher with a cumulative draft of 10-40% when a temperature is in a range of 780-830° C., and subsequently, accelerated cooling at a cooling rate of 8-80° C./sec is started from 700° C. or higher and is stopped at a temperature between room temperature and 350° C.

10 Claims, No Drawings

METHOD OF MANUFACTURING HIGH TENSILE STRENGTH THICK STEEL PLATE

This application is a national stage application of International Application No. PCT/JP2009/056664, filed 31 Mar. 2009, which claims priority to Japanese Application Nos. 2008-095021, filed 1 Apr. 2008; and 2009-061630, filed 13 Mar. 2009, each of which is incorporated by reference in its entirety.

TECHNICAL FIELD OF THE INVENTION

The present invention relates to a method of manufacturing a high tensile strength thick steel plate with a tensile strength of 780 Mpa or more which has high preheating-free weldability and excellent low-temperature toughness of a welded joint with high productivity at low cost without using expensive Ni and requiring a reheating tempering heat treatment after rolling.

Priority is claimed on Japanese Patent Application No. 2009-061630, filed on Mar. 13, 2009, and Japanese Patent Application No. 2008-095021, filed on Apr. 1, 2008, the contents of which are incorporated herein by reference.

BACKGROUND ART

High tensile strength steel plates with a tensile strength of 780 MPa or more which are used as welding structural members for construction machines, industrial machines, bridges, buildings, ships and the like are required to have, in addition to compatibility between high strength and high toughness of a base material, high preheating-free high weldability and excellent low-temperature toughness of a welded joint with an increase in the need for constructional members with a high strength and an increase in use in cold regions. In addition, thick steel plates of 780 MPa or more which satisfy all such features and can be manufactured at low cost in a short construction time are required to have a thickness of up to about 40 mm. Therefore, steel plates are required to satisfy all three features, (a) high strength and high toughness of a base material, (b) a preheating-free characteristic in low heat input welding where the heat input amount is 2.0 kJ/mm or less, and (c) low-temperature toughness of a welded joint, with a low-cost component system in a short construction time and low cost manufacturing process.

As a conventional method of manufacturing high tensile strength thick steel plates of 780 MPa or more which have high weldability applied thereto, for example, Patent Documents 1 to 3 disclose a method with direct hardening and tempering, including processes of directly hardening a steel plate in an on-line process immediately after the steel plate is rolled, and subsequently tempering the steel plate.

Regarding methods of manufacturing high tensile strength thick steel plates of 780 MPa or more involving no thermal refining, for example, Patent Documents 4 to 8 disclose manufacturing methods which are excellent in terms of manufacturing time period and productivity from the viewpoint that a reheating tempering heat treatment can be omitted. Among these Patent Documents, Patent Documents 4 to 7 disclose manufacturing methods which use an accelerated cooling mid-course stoppage process in which accelerated cooling after rolling of a steel plate is stopped in mid-course, and Patent Document 8 discloses a manufacturing method in which air cooling is performed after rolling to cool the temperature down to room temperature.

Patent Document 1: Japanese Unexamined Patent Application, First Publication No. H03-232923

Patent Document 2: Japanese Unexamined Patent Application, First Publication No. H09-263828

Patent Document 3: Japanese Unexamined Patent Application, First Publication No. 2000-160281

Patent Document 4: Japanese Unexamined Patent Application, First Publication No. 2000-319726

Patent Document 5: Japanese Unexamined Patent Application, First Publication No. 2005-15859

Patent Document 6: Japanese Unexamined Patent Application, First Publication No. 2004-52063

Patent Document 7: Japanese Unexamined Patent Application, First Publication No. 2001-226740

Patent Document 8: Japanese Unexamined Patent Application, First Publication No. H08-188823

DISCLOSURE OF THE INVENTION

Problem that the Invention is to Solve

However, in the conventional techniques disclosed in Patent Documents 1 to 3, the reheating tempering heat treatment is required and thus problems regarding the manufacturing time period, productivity and manufacturing cost may arise. Accordingly, there is a strong demand for a so-called no thermal refining manufacturing method in which the reheating tempering heat treatment can be omitted. In addition, in the manufacturing method disclosed in Patent Document 4, preheating of 50° C. or more is required in welding as described in the embodiments thereof, and thus the high preheating-free weldability requirement cannot be satisfied. Further, in the manufacturing method disclosed in Patent Document 5, since 0.6% or more of Ni is required to be added to the steel plate, the component system becomes expensive and thus a problem regarding the manufacturing cost may arise. In the manufacturing method disclosed in Patent Document 6, steel plates with a thickness of up to 15 mm can be manufactured as described in the embodiments thereof, thus, a demand for a thickness of up to 40 mm cannot be satisfied. Further, even if a steel plate having the thickness of 15 mm is manufactured, the C content is small and thus the microstructure of a welded joint becomes coarse, and there is a problem in that the welded joint cannot obtain sufficient low-temperature toughness. In the manufacturing method disclosed in Patent Document 7, since the addition of about 1.0% of Ni is required as described in the embodiments thereof, the component system becomes expensive and thus a problem regarding manufacturing cost may arise. In the manufacturing method disclosed in Patent Document 8, only the steel plates having a thickness of up to 12 mm can be manufactured as described in the embodiments thereof, thus, a demand for a thickness of up to 40 mm cannot be satisfied. In addition, as a feature of the rolling conditions, rolling is performed in such a manner that a cumulative draft is controlled to be 16-30% in a two-phase temperature range of ferrite and austenite. Accordingly, ferrite grains easily become coarse and thus there are problems in that the strength and the toughness are easily reduced in the manufacturing of the steel plates having a thickness of 12 mm.

As described above, despite the strong consumer demand for a method of manufacturing high tensile strength thick steel plates in which all the requirements of high strength and high toughness of a base material, high weldability and low-temperature toughness of a welded joint can be satisfied in a condition that Ni, which is an expensive alloy element, is not added and that a reheating tempering heat treatment after rolling/cooling is omitted, such method has not yet been developed.

In thick steel plates having a base material strength of 780 MPa or more, the influence of thickness of the steel plates on the preheating-free characteristic is very significant. When the thickness of the steel plate is less than 12 mm, the preheating-free characteristic can be easily achieved. If the thickness of the steel plate is less than 12 mm, a cooling rate of the steel plate during water cooling can be 100° C./sec or more even in a thickness center portion. In this case, the structure of a base material can be converted into a bainite or martensite structure by adding a small amount of alloy element. Then, the base material with the strength of 780 MPa or more can be obtained. Since small additional amount of the alloy element is required, hardness of a weld heat-affected zone can be suppressed at a low level without preheating and weld cracking can thus be prevented even without preheating.

On the other hand, if the thickness of a steel plate is thick, the cooling rate during the water cooling is necessarily reduced. Accordingly, with the same components as those of the thin steel plate, the strength of the thick steel plate is reduced because of insufficient hardening, and the strength requirement of 780 MPa or more cannot be satisfied. Particularly, the strength in the thickness center portion (½t parts) in which the cooling rate becomes minimum is apparently reduced. In the case of manufacturing a thick steel plate with a thickness of more than 40 mm of which a cooling rate is less than 8° C./sec, it is necessary to add a large amount of alloy element to ensure the strength of a base material and thus it is very difficult to achieve the preheating-free characteristic.

Accordingly, an object of the present invention is to provide a method of manufacturing a high tensile strength thick steel plate with a tensile strength of 780 MPa or more which has excellent weldability and low-temperature toughness and in which all the requirements of high strength and high toughness of a base material, high weldability and low-temperature toughness of a welded joint can be satisfied in conditions that Ni, which is an expensive alloy element, is not added and that a reheating tempering heat treatment after rolling/cooling is omitted.

Concrete features of the steel plate which is a target of the present invention are as follows.

(a) In a thickness center portion of a base material, a tensile strength is 780 MPa or more, and preferably 1000 MPa or less, yield stress is 685 MPa or more, and Charpy absorbed energy at −80° C. is 100 J or more.

(b) A required preheating temperature for preventing weld cracking during a y-type weld cracking test at a room temperature is 25° C. or less, or the preheating is not required.

(c) Charpy absorbed energy of a weld heat-affected zone (HAZ) of a joint subjected to submerged arc welding (SAW) at a welding heat input of 3.0 kJ/mm is 60 J or more at −50° C.

In addition, the steel plate thickness in the range of 12 to 40 mm is a target of the present invention.

Means for Solving the Problem

In order to solve the above-described problems, the present inventors conducted a number of examinations of base materials and welded joints on the basis of the assumption of manufacturing by direct hardening after rolling in a component system in which Ni is not added thereto. There were two problems which were difficult to solve. One is the ensuring of low-temperature toughness of a welded joint without the addition of Ni. Regarding this problem, various examinations were performed on the influence of added components on the toughness of a heat-affected zone (HAZ) of a joint subjected to submerged arc welding (SAW) at a welding heat input of about 3.0 kJ/mm. As a result, it was newly discovered that good welded joint toughness can be obtained at −50° C. without the addition of Ni, only in the case where the C content is strictly regulated to be 0.03% or more and 0.055% or less; the hardenability of the steel which can be evaluated by a hardenability index (DI value) is in an optimum range of 1.00 to 2.60; and none of the five elements Mo, V, Si, Ti and B are added to the steel.

Further, in order to achieve the preheating-free characteristic in low heat input welding such as shielded metal arc, TIG or MIG welding where the heat input amount is 2.0 kJ/mm or less, on the basis of the new knowledge, an examination was performed relating to weldability with the components satisfying the above-described C amount and the range of the DI value without the addition of Ni and the five elements, Mo, V, Si, Ti and B. As a result, it was found that by regulating Pcm value representing weld cracking sensitivity to 0.24% or less, a required preheating temperature for preventing weld cracking during a y-type weld cracking test can be controlled to be 25° C. or less, or the preheating is not required, and the preheating-free characteristic can thus be achieved.

However, the other problem which was difficult to solve was compatibility between base material strength and base material toughness over the whole thickness of up to 40 mm in a thickness direction when assuming that a Pcm value is 0.24% or less. For this, a large amount of Mn, for example in the amount of 3.0% or more, was added, Nb, which is generally effective in obtaining the high strength and the high toughness by making the structure fine, was conversely not added, and 0.20% or more of the Pcm value was satisfied. Moreover, as for the rolling conditions, a cumulative draft in each of two temperature ranges of an austenite recrystallization temperature range of 850° C. or higher, and an austenite unrecrystallization temperature range of 780-830° C. was strictly regulated. Immediately after the rolling, cooling was performed at a cooling rate of 8-80° C./sec, from the temperature of 700° C. or higher down to the temperature between room temperature and 350° C. It was newly discovered that under these conditions, the compatibility requirement between the strength and the toughness of the base material over the whole thickness of up to 40 mm in the thickness direction can be satisfied, that is, requirements of 780 MPa or more of a tensile strength, 685 MPa or more of yield stress and 100 J or more of Charpy absorbed energy at −80° C. can be satisfied.

The present invention is contrived based on the above new knowledge, and the gist of the invention is as follows.

(1) A method of manufacturing a high-tensile strength thick steel plate with a tensile strength of 780 MPa or more, the method including: heating to 950-1100° C. a steel slab or a cast slab having a component composition which includes, in mass %, 0.030-0.055% of C, 3.0-3.5% of Mn, 0.002-0.10% of Al, 0.01% or less of P, 0.0010% or less of S, 0.0060% or less of N, 0.03% or less of Mo, 0.09% or less of Si, 0.01% or less of V, 0.003% or less of Ti, 0.0003% or less of B, 0.003% or less of Nb, and the balance Fe with inevitable impurities, and of which Pcm value representing a weld cracking parameter is fallen within the range of 0.20-0.24% and DI value representing a hardenability index is fallen within the range of 1.00-2.60, wherein when [C], [Si], [Mn], [Cu], [Ni], [Cr], [Mo], [V], [Al] and [B] are the amounts, expressed in mass %, of C, Si, Mn, Cu, Ni, Cr, Mo, V, Al and B respectively, the Pcm value and the DI value are given as follows, Pcm=[C]+[Si]/30+[Mn]/20+[Cu]/20+[Ni]/60+[Cr]/20+[Mo]/15+M/10+5

[B], DI=0.367([C]$^{1/2}$)(1+0.7[Si])(1+3.33[Mn])(1+0.35[Cu])(1+0.36[Ni])(1+2.16[Cr])(1+3.0[Mo])(1+1.75[V])(1+1.77[Al]); performing a first rolling with a cumulative draft of 70-90% when a temperature is in a range of 850° C. or more; performing a second rolling at 780° C. or higher after performing the first rolling, with a cumulative draft of 10-40% when a temperature is in a range of 780-830° C.; starting accelerated cooling at a cooling rate of 8-80° C./sec from 700° C. or higher after performing the second rolling; and stopping the accelerated cooling at a temperature between room temperature and 350° C.

(2) The Method of manufacturing a high tensile strength thick steel plate according to (1), in which the steel slab or the cast slab further contains one or both of 0.05-0.20% of Cu and 0.05-1.00% of Cr in mass %.

(3) The method of manufacturing a high tensile strength thick steel plate according to (1), in which the steel slab or the cast slab further contains one or both of 0.0005-0.01% of Mg and 0.0005-0.01% of Ca in mass %.

(4) The method of manufacturing a high tensile strength thick steel plate according to (1), in which a thick steel plate having a thickness of 12-40 mm is manufactured.

Effects of the Invention

According to the present invention, a high tensile strength thick steel plate with a tensile strength of 780 MPa or more and a thickness of 12-40 mm, which is suitable as a structural member for welding structures such as construction machines, industrial machines, bridges, buildings, ships and the like strongly requiring high strength and which has excellent preheating-free weldability, can be manufactured with high productivity and low cost without using expensive Ni and without requiring a reheating tempering heat treatment after rolling. The effect thereof on the industrial field is very significant.

BEST MODE FOR CARRYING OUT THE INVENTION

The steel according to the present invention is used in the form of a thick steel plate with a thickness of 12-40 mm which is used as a structural member for welding structures such construction machines, industrial machines, bridges, buildings, ships and the like. In the present invention, the word of preheating-free indicates that, in "y-type weld cracking test" according to JIS Z 3158 using shielded metal arc welding, TIG welding or MIG welding with 2.0 kJ/mm or less of the heat input amount in room temperature, the preheating temperature required for preventing weld cracking is 25° C. or less, or preheating is not needed.

Hereinafter, a description will be given of reasons for limits in components and a manufacturing method in the present invention.

C is an important element in the present invention. In order to satisfy all the requirements of strength and toughness of a base material, high weldability, and low-temperature toughness of a welded joint, it is necessary to strictly regulate the additional amount of C to be fallen within the range of 0.030-0.055%. When the additional amount of C is less than 0.030%, the transformation temperature in cooling becomes high in the base material and a weld heat-affected zone and thus a ferrite structure is generated. Thus, the strength and toughness of the base material and the welded joint toughness are lowered. When the additional amount of C is more than 0.055%, a required preheating temperature in welding exceeds 25° C. and thus the preheating-free requirement cannot be satisfied. In addition, since the weld heat-affected zone is hardened, the welded joint toughness requirement also cannot be satisfied.

Mn is an important element in the present invention. For compatibility between strength and toughness of a base material, a large amount of Mn, for example in an amount of 3.0% or more, is required to be added. When Mn is added in an amount more than 3.5%, coarse MnS is generated which has a harmful effect on the toughness in a center segregation portion, and thus the toughness of the base material in a thickness center portion is reduced. Accordingly, the upper limit thereof is set to 3.5%.

Al is a deoxidizing element and is required to be added in an amount of 0.002% or more. When Al is added in an amount more than 0.10%, coarse alumina inclusions are generated and toughness is thus reduced in some cases. Accordingly, the upper limit thereof is set to 0.10%. The lower limit of the additional mount of Al may be limited to 0.020%. The upper limit of the additional amount of Al may be limited to 0.08% or 0.05%.

It is preferable that P is not contained because P reduces the low-temperature toughness of a welded joint and a base material. The acceptable amount of P as an impurity element which is inevitably incorporated is 0.01% or less. In addition, the acceptable amount of P may be limited to be 0.009% or less.

It is not preferable that S is contained because in the present invention employing a method of adding a large amount of Mn, S generates coarse MnS to reduce the toughness of a welded joint and a base material. Since Ni, which is effective in compatibility between high strength and high toughness but unfortunately expensive material, is not used in the present invention, the harmful effect of coarse MnS is significant. Therefore, it is necessary to strictly regulate the acceptable amount of S so that the inevitably incorporated amount of S as an impurity element becomes 0.0010% or less.

Regarding N, when N is added in an amount of 0.0060% or more, the toughness of a welded joint and a base material is reduced, so the upper limit thereof is set to 0.0060%.

It is not preferable that the five elements, Mo, Si, V, Ti and B are contained. However, the upper limits of the inevitably incorporated amounts of the five elements as impurity elements are as follows: 0.03% of Mo, 0.09% of Si, 0.01% of V, 0.003% of Ti, and 0.0003% of B.

Mo, Si, V, Ti and B are particularly significant elements in the present invention, and only in the case in which all of the amounts of these five elements are less than the above-described upper limits, good welded joint toughness can be achieved at −50° C. without adding Ni. When even one of the five elements exceeds the upper limit, a coarse bainite structure including island-like martensite which is an embrittlement structure, or TiN as harmful inclusions, is generated in a HAZ. It is considered as the reason for achieving good low-temperature toughness of a welded joint that neither the coarse bainite structure including island-like martensite nor TiN are generated, only in the case in which all of the amounts of the five elements are less than the above-described upper limits. Since Ni, which is effective in compatibility between high strength and high toughness but unfortunately expensive material, is not used in the present invention, the harmful effect of the coarse bainite structure including island-like martensite and TiN is significant. Therefore, it is not preferable that the five elements are contained in the present invention.

Nb is an important element in the present invention. When Nb is added, the strength and toughness of a base material cannot be obtained. In general, Nb is effective to make the base material have fine structure in order to obtain high strength and high toughness. However, in the component system in which the C content is small and Mn is added in a large amount as in the present invention, strain during rolling is excessively accumulated due to the addition of Nb, and thus a ferrite structure or a coarse bainite structure including island-like martensite is locally generated during rolling and subsequent cooling. Accordingly, a high strength and a high toughness of the base material cannot be obtained. Though it is not preferable that Nb is contained, but the upper limit of the inevitably incorporated amount of Nb as an impurity element is 0.003%.

Mo, V, Ti and Nb are expensive elements like Ni. Accordingly, the present invention in which good features are obtained without adding these expensive elements has a greater merit in terms of the reduction of the alloy cost than in the case in which Ni is simply not added.

Cu may be added in regulation ranges of a Pcm value and a DI value to ensure the strength of a base material. In order to obtain this effect, 0.05% or more of Cu is required to be added. However, when 0.20% or more of Cu is added without adding Ni, problems regarding the manufacturing time period, productivity, and manufacturing cost due to the generation of surface cracking in steel plates and steel slabs may arise. Accordingly, the upper limit thereof is set to 0.20%. Specifically, the content of Cu which is inevitably incorporated is 0.03% or less.

Cr may be added within the regulation ranges of the Pcm value and the DI value in order to ensure the strength of a base material. In order to obtain this effect, 0.05% or more of Cr is required to be added. However, when Cr is added in an amount of more than 1.00%, the toughness of a welded joint and the base material is reduced, so the upper limit is set to 1.00%. The inevitably incorporated amount of Cr is set to 0.03% or less. Meanwhile, the upper limit of the adding amount of Cr may be limited to 0.50% or 0.30%.

By adding one or both of Mg and Ca, fine sulfides and oxides are formed, and base material toughness and welded joint toughness can thus be increased. In order to obtain this effect, it is necessary to add Mg or Ca in an amount of 0.0005% or more. However, when Mg or Ca is added in an amount exceeding 0.01%, coarse sulfides and oxides are generated and the toughness is thus reduced. Accordingly, the additional amounts of Mg and Ca are respectively set to be 0.0005% or more and 0.01% or less. The upper limit of the additional amount of Ca may be limited to 0.005% or 0.002%.

In the present invention, Ni is not added. However, the case in which Ni is inevitably incorporated from raw material scraps is within the scope of the invention because it is not expensive even when Ni is contained. The inevitably incorporated amount of Ni is set to be 0.03% or less.

When the Pcm value, which indicates weld cracking sensitivity, is more than 0.24%, the preheating-free characteristic cannot be derived in the welding. Accordingly; the upper limit of the Pcm value is set to be 0.24% or less. Meanwhile, When the Pcm value is less than 0.20%, it is impossible to obtain a base material with a high strength and a high toughness, and thus the lower limit thereof is set to 0.20%.

Herein, Pcm is represented by [C]+[Si]/30+[Mn]/20+[Cu]/20+[Ni]/60+[Cr]/20+[Mo]/15+[V]/10+5[B], wherein [C], [Si], [Mn], [Cu], [Ni], [Cr], [Mo], [V] and [B] are the amounts, expressed in mass %, of C, Si, Mn, Cu, Ni, Cr, Mo, V and B, respectively.

When DI value, which indicates hardenability, is less than 1.00, the hardenability of a HAZ becomes insufficient, and a coarse bainite structure including island-like martensite which is an embrittlement structure is thus generated, and as a result, the low-temperature toughness of a welded joint is reduced. Accordingly, the lower limit thereof is set to 1.00. When the DI value is more than 2.60, the structure of the HAZ includes a large amount of low-toughness martensite and thus the low-temperature toughness of the welded joint is reduced. Accordingly, the upper limit thereof is set to 2.60. The upper limit of the DI value may be 2.00, 1.80 or 1.60.

Herein, DI is represented by $0.367([C]^{1/2})(1+0.7[Si])(1+3.33[Mn])(1+0.35[Cu])(1+0.36[Ni])(1+2.16[Cr])(1+3.0[Mo])(1+1.75[V])(1+1.77[Al])$.

Herein, [C], [Si], [Mn], [Cu], [Ni], [Cr], [Mo], [V] and [Al] mean the amounts, expressed in mass %, of C, Si, Mn, Cu, Ni, Cr, Mo, V and Al, respectively. Coefficients of the elements in the hardenability index (DI value) are described in Nippon Steel Technical Report No. 348 (1993), p. 11.

Next, a description of the manufacturing method other than the component composition will be given.

A heating temperature for steel slabs or cast slabs is required to be 950° C. or more for rolling. When the heating temperature is higher than 1100° C., austenite grains become coarse and toughness is thus reduced. Particularly, since Ni is not added in the present invention, a good base material toughness is not obtained when initial austenite grains at the time of heating are not made fine grains. In the component system according to the present invention in which the amount of C is small and Nb is not added, an effect of suppressing the growth of austenite grains by solid solution C or NbC is small and the initial austenite grains at the time of heating easily become coarse. Accordingly, the upper limit of the heating temperature is required to be strictly regulated to 1100° C.

A cumulative draft when in a temperature range at which austenite is recrystallized is required to be 70% or more in order to obtain high strength and high toughness of a base material through sufficient isotropic refining of austenite grains. The sufficient austenite recrystallization temperature range for the steel according to the present invention is 850° C. or more. Accordingly, it is necessary to set the cumulative draft when a temperature is 850° C. or more to be 70% or more. Herein, the cumulative draft is the result which is obtained by dividing the total reduced thickness in rolling when a temperature is 850° C. or more by a rolling start thickness, that is, a steel slab thickness or a cast slab thickness, and is expressed by %. When the cumulative draft is more than 90%, rolling is performed for a long time period and thus productivity is reduced. Thus, the upper limit thereof is set to 90%.

A cumulative draft in a temperature range at which austenite is not recrystallized is required to be 10% or more in order to obtain a base material with a high strength and a high toughness. The sufficient austenite unrecrystallization temperature range for the steel according to the present invention is in the range of 780-830° C. Accordingly, it is necessary to set the cumulative draft when a temperature is fallen within the range of 780-830° C. to be 10% or more. Herein, the cumulative draft is the result which is obtained by dividing the total reduced thickness in rolling when a temperature is fallen within the range of 780-830° C. by a rolling start thickness at a temperature in the range of 780-830° C. and is expressed by %. When the cumulative draft is more than 40%, a ferrite structure or a coarse bainite structure including island-like martensite is locally generated due to the excess accumulation of rolling strain and thus a base material with a high strength and high toughness cannot be obtained. Accordingly, the upper limit thereof is set to 40%.

Similarly, when a rolling temperature is lower than 780° C., a ferrite structure or a coarse bainite structure including island-like martensite is locally generated due to the excess accumulation of rolling strain and thus a base material with a high strength and high toughness cannot be obtained. Accordingly, the lower limit of the rolling temperature is regulated to 780° C.

When a start temperature of accelerated cooling after rolling is lower than 700° C., a ferrite structure or a coarse bainite structure including island-like martensite is locally generated and thus a base material with a high strength and high toughness cannot be obtained. Accordingly, the lower limit temperature thereof is set to 700° C.

When a cooling rate of accelerated cooling is less than 8° C./sec, a ferrite structure or a coarse bainite structure including island-like martensite is locally generated and thus a base material with a high strength and high toughness cannot be obtained. Accordingly, the lower limit thereof is set to 8° C./sec. The upper limit is 80° C./sec, which is a cooling rate which can be stably achieved by water cooling.

When a stop temperature of accelerated cooling is higher than 350° C., particularly, in the thickness center portion of a thick member having a thickness of 30 mm or more, a coarse bainite structure including island-like martensite is generated due to insufficient hardening and thus a base material with a high strength and high toughness cannot be obtained. Accordingly, the upper limit of the stop temperature is set to 350° C. Here, the stop temperature is the surface-temperature of a steel plate when the temperature of the steel plate is restored after cooling. The lower limit of the stop temperature is a room temperature, but a more preferable stop temperature is 100° C. or more from the viewpoint of dehydrogenation of the steel plate.

EXAMPLES

Steel slabs obtained by producing steel having component compositions shown in Tables 1-3 were made into steel plates having thicknesses of 12-40 mm under the manufacturing conditions shown in Tables 4-7. Numbers 1-21 of Table 4 are examples according to the present invention and numbers 22-73 of Tables 5-7 are comparative examples. In the Tables, the underlined numerals and symbols indicate that the manufacturing conditions such as components or rolling conditions are beyond the patent ranges, or that the features do not satisfy the following target values. In Tables 1-3, the Ni content indicates an inevitably incorporated amount as an impurity element.

TABLE 1

| | | Chemical Composition (mass %) | | | | | | | | | |
|---|---|---|---|---|---|---|---|---|---|---|---|
| | Steel | C | Si | Mn | P | S | Cu | Ni | Cr | Mo | Nb |
| Steel According to the Present Invention | A | 0.030 | 0.05 | 3.33 | 0.007 | 0.0005 | 0.01 | 0.00 | 0.10 | 0.00 | 0.002 |
| | B | 0.041 | 0.09 | 3.40 | 0.001 | 0.0009 | 0.00 | 0.00 | 0.03 | 0.00 | 0.002 |
| | C | 0.055 | 0.03 | 3.30 | 0.007 | 0.0007 | 0.00 | 0.02 | 0.01 | 0.02 | 0.002 |
| | D | 0.047 | 0.03 | 3.00 | 0.005 | 0.0005 | 0.00 | 0.00 | 0.12 | 0.02 | 0.001 |
| | E | 0.044 | 0.03 | 3.50 | 0.005 | 0.0005 | 0.03 | 0.01 | 0.01 | 0.03 | 0.000 |
| | F | 0.041 | 0.04 | 3.41 | 0.009 | 0.0007 | 0.02 | 0.01 | 0.02 | 0.00 | 0.003 |
| | G | 0.048 | 0.03 | 3.40 | 0.008 | 0.0007 | 0.02 | 0.01 | 0.02 | 0.00 | 0.002 |
| | H | 0.042 | 0.04 | 3.36 | 0.009 | 0.0009 | 0.10 | 0.03 | 0.00 | 0.01 | 0.001 |
| | I | 0.051 | 0.06 | 3.00 | 0.005 | 0.0005 | 0.20 | 0.03 | 0.03 | 0.00 | 0.002 |
| | J | 0.052 | 0.03 | 3.05 | 0.004 | 0.0005 | 0.00 | 0.00 | 0.58 | 0.02 | 0.002 |
| | K | 0.030 | 0.08 | 3.15 | 0.009 | 0.0006 | 0.00 | 0.01 | 1.00 | 0.00 | 0.000 |
| | L | 0.037 | 0.05 | 3.41 | 0.003 | 0.0005 | 0.00 | 0.02 | 0.03 | 0.02 | 0.003 |
| | M | 0.049 | 0.03 | 3.20 | 0.004 | 0.0006 | 0.03 | 0.01 | 0.02 | 0.01 | 0.002 |
| | N | 0.048 | 0.04 | 3.45 | 0.005 | 0.0007 | 0.08 | 0.02 | 0.07 | 0.01 | 0.000 |

| | | Chemical Composition (mass %) | | | | | | | Index | |
|---|---|---|---|---|---|---|---|---|---|---|
| | Steel | V | Ti | Al | B | Mg | Ca | N | Pcm* | DI** |
| Steel According to the Present Invention | A | 0.000 | 0.001 | 0.016 | 0.0001 | 0.0000 | 0.0002 | 0.0024 | 0.204 | 1.00 |
| | B | 0.000 | 0.002 | 0.008 | 0.0000 | 0.0001 | 0.0003 | 0.0039 | 0.216 | 1.05 |
| | C | 0.000 | 0.001 | 0.023 | 0.0001 | 0.0003 | 0.0003 | 0.0021 | 0.224 | 1.20 |
| | D | 0.000 | 0.002 | 0.026 | 0.0001 | 0.0004 | 0.0000 | 0.0042 | 0.206 | 1.25 |
| | E | 0.008 | 0.001 | 0.045 | 0.0002 | 0.0000 | 0.0004 | 0.0028 | 0.226 | 1.23 |
| | F | 0.000 | 0.001 | 0.002 | 0.0003 | 0.0012 | 0.0020 | 0.0028 | 0.217 | 1.00 |
| | G | 0.000 | 0.000 | 0.100 | 0.0002 | 0.0003 | 0.0000 | 0.0044 | 0.222 | 1.26 |
| | H | 0.000 | 0.000 | 0.008 | 0.0002 | 0.0002 | 0.0003 | 0.0023 | 0.219 | 1.03 |
| | I | 0.005 | 0.003 | 0.049 | 0.0000 | 0.0004 | 0.0005 | 0.0045 | 0.216 | 1.20 |
| | J | 0.009 | 0.000 | 0.012 | 0.0001 | 0.0005 | 0.0005 | 0.0034 | 0.237 | 2.36 |
| | K | 0.000 | 0.000 | 0.036 | 0.0000 | 0.0001 | 0.0001 | 0.0032 | 0.240 | 2.60 |
| | L | 0.000 | 0.000 | 0.009 | 0.0002 | 0.0025 | 0.0003 | 0.0026 | 0.213 | 1.04 |
| | M | 0.000 | 0.002 | 0.037 | 0.0000 | 0.0001 | 0.0019 | 0.0032 | 0.213 | 1.12 |
| | N | 0.000 | 0.000 | 0.030 | 0.0000 | 0.0000 | 0.0015 | 0.0031 | 0.230 | 1.33 |

*Pcm = C + Si/30 + Mn/20 + Cu/20 + Ni/60 + Cr/20 + Mo/15 + V/10 + 5B

**DI = $0.367(C)^{1/2}(1 + 0.7Si)(1 + 3.33Mn)(1 + 0.35Cu)(1 + 0.36Ni)(1 + 2.16Cr)(1 + 3.0Mo)(1 + 1.75V)(1 + 1.77Al)$

TABLE 2

| | Steel | Chemical Composition (mass %) | | | | | | | | | |
|---|---|---|---|---|---|---|---|---|---|---|---|
| | | C | Si | Mn | P | S | Cu | Ni | Cr | Mo | Nb |
| Comparative Steel | O | 0.027 | 0.06 | 3.21 | 0.007 | 0.0005 | 0.03 | 0.01 | 0.23 | 0.02 | 0.001 |
| | P | 0.059 | 0.08 | 3.28 | 0.003 | 0.0005 | 0.04 | 0.01 | 0.18 | 0.01 | 0.003 |
| | Q | 0.054 | 0.12 | 3.35 | 0.008 | 0.0005 | 0.03 | 0.00 | 0.03 | 0.03 | 0.002 |
| | R | 0.052 | 0.07 | 2.90 | 0.007 | 0.0008 | 0.03 | 0.02 | 0.01 | 0.03 | 0.003 |
| | S | 0.052 | 0.07 | 3.63 | 0.002 | 0.0007 | 0.00 | 0.00 | 0.01 | 0.01 | 0.002 |
| | T | 0.048 | 0.04 | 3.46 | 0.013 | 0.0005 | 0.02 | 0.02 | 0.19 | 0.02 | 0.002 |
| | U | 0.052 | 0.08 | 3.23 | 0.002 | 0.0012 | 0.02 | 0.02 | 0.28 | 0.01 | 0.002 |
| | V | 0.030 | 0.04 | 3.00 | 0.007 | 0.0005 | 0.00 | 0.00 | 1.10 | 0.00 | 0.000 |
| | W | 0.054 | 0.07 | 3.29 | 0.006 | 0.0008 | 0.00 | 0.02 | 0.25 | 0.04 | 0.003 |
| | X | 0.053 | 0.07 | 3.30 | 0.007 | 0.0009 | 0.01 | 0.01 | 0.00 | 0.15 | 0.001 |
| | Y | 0.030 | 0.04 | 3.13 | 0.007 | 0.0008 | 0.03 | 0.02 | 0.36 | 0.00 | 0.004 |
| | Z | 0.034 | 0.02 | 3.35 | 0.007 | 0.0007 | 0.01 | 0.03 | 0.01 | 0.03 | 0.025 |
| | AA | 0.053 | 0.08 | 3.39 | 0.003 | 0.0009 | 0.00 | 0.02 | 0.03 | 0.03 | 0.003 |
| | AB | 0.035 | 0.03 | 3.42 | 0.004 | 0.0006 | 0.00 | 0.00 | 0.25 | 0.01 | 0.001 |
| | AC | 0.053 | 0.06 | 3.36 | 0.002 | 0.0008 | 0.01 | 0.02 | 0.01 | 0.00 | 0.001 |
| | AD | 0.048 | 0.07 | 3.30 | 0.008 | 0.0007 | 0.10 | 0.02 | 0.15 | 0.03 | 0.000 |
| | AE | 0.039 | 0.03 | 3.20 | 0.006 | 0.0005 | 0.03 | 0.01 | 0.03 | 0.01 | 0.001 |
| | AF | 0.049 | 0.06 | 3.18 | 0.003 | 0.0008 | 0.02 | 0.02 | 0.00 | 0.00 | 0.001 |
| | AG | 0.049 | 0.06 | 3.18 | 0.003 | 0.0008 | 0.02 | 0.02 | 0.00 | 0.00 | 0.001 |
| | AH | 0.038 | 0.02 | 3.43 | 0.004 | 0.0005 | 0.00 | 0.03 | 0.03 | 0.02 | 0.002 |
| | AI | 0.040 | 0.04 | 3.22 | 0.008 | 0.0006 | 0.03 | 0.03 | 0.00 | 0.03 | 0.000 |
| | AJ | 0.053 | 0.02 | 3.24 | 0.002 | 0.0007 | 0.04 | 0.00 | 0.03 | 0.03 | 0.003 |

| | Steel | Chemical Composition (mass %) | | | | | | | Index | |
|---|---|---|---|---|---|---|---|---|---|---|
| | | V | Ti | Al | B | Mg | Ca | N | Pcm* | DI** |
| Comparative Steel | O | 0.001 | 0.001 | 0.024 | 0.0003 | 0.0000 | 0.0001 | 0.0028 | 0.206 | 1.23 |
| | P | 0.002 | 0.000 | 0.036 | 0.0001 | 0.0000 | 0.0002 | 0.0043 | 0.238 | 1.74 |
| | Q | 0.000 | 0.001 | 0.026 | 0.0003 | 0.0000 | 0.0001 | 0.0049 | 0.232 | 1.38 |
| | R | 0.001 | 0.003 | 0.036 | 0.0001 | 0.0000 | 0.0003 | 0.0025 | 0.204 | 1.13 |
| | S | 0.001 | 0.000 | 0.035 | 0.0003 | 0.0000 | 0.0001 | 0.0033 | 0.239 | 1.29 |
| | T | 0.001 | 0.000 | 0.046 | 0.0003 | 0.0001 | 0.0003 | 0.0030 | 0.236 | 1.70 |
| | U | 0.003 | 0.001 | 0.030 | 0.0000 | 0.0000 | 0.0003 | 0.0054 | 0.232 | 1.84 |
| | V | 0.000 | 0.000 | 0.038 | 0.0000 | 0.0002 | 0.0000 | 0.0053 | 0.236 | 2.59 |
| | W | 0.003 | 0.002 | 0.042 | 0.0001 | 0.0000 | 0.0000 | 0.0037 | 0.237 | 2.01 |
| | X | 0.002 | 0.002 | 0.031 | 0.0001 | 0.0002 | 0.0000 | 0.0023 | 0.232 | 1.64 |
| | Y | 0.002 | 0.000 | 0.041 | 0.0003 | 0.0002 | 0.0000 | 0.0037 | 0.209 | 1.45 |
| | Z | 0.002 | 0.000 | 0.038 | 0.0003 | 0.0003 | 0.0000 | 0.0021 | 0.207 | 1.01 |
| | AA | 0.012 | 0.000 | 0.044 | 0.0001 | 0.0001 | 0.0000 | 0.0033 | 0.231 | 1.41 |
| | AB | 0.057 | 0.003 | 0.031 | 0.0003 | 0.0001 | 0.0000 | 0.0046 | 0.227 | 1.60 |
| | AC | 0.000 | 0.007 | 0.034 | 0.0000 | 0.0003 | 0.0000 | 0.0057 | 0.224 | 1.17 |
| | AD | 0.001 | 0.015 | 0.050 | 0.0000 | 0.0001 | 0.0003 | 0.0045 | 0.230 | 1.66 |
| | AE | 0.001 | 0.002 | 0.120 | 0.0001 | 0.0000 | 0.0003 | 0.0041 | 0.204 | 1.17 |
| | AF | 0.000 | 0.003 | 0.052 | 0.0005 | 0.0002 | 0.0001 | 0.0052 | 0.214 | 1.09 |
| | AG | 0.000 | 0.003 | 0.052 | 0.0015 | 0.0002 | 0.0001 | 0.0052 | 0.219 | 1.09 |
| | AH | 0.001 | 0.003 | 0.054 | 0.0003 | 0.0115 | 0.0003 | 0.0041 | 0.215 | 1.13 |
| | AI | 0.001 | 0.000 | 0.029 | 0.0000 | 0.0000 | 0.0120 | 0.0043 | 0.206 | 1.04 |
| | AJ | 0.003 | 0.002 | 0.023 | 0.0000 | 0.0000 | 0.0000 | 0.0065 | 0.221 | 1.24 |

*Pcm = C + Si/30 + Mn/20 + Cu/20 + Ni/60 + Cr/20 + Mo/15 + V/10 + 5B

**DI = $0.367(C)^{1/2}(1 + 0.7Si)(1 + 3.33Mn)(1 + 0.35Cu)(1 + 0.36Ni)(1 + 2.16Cr)(1 + 3.0Mo)(1 + 1.75V)(1 + 1.77Al)$

TABLE 3

| | Steel | Chemical Composition (mass %) | | | | | | | | | |
|---|---|---|---|---|---|---|---|---|---|---|---|
| | | C | Si | Mn | P | S | Cu | Ni | Cr | Mo | Nb |
| Comparative Steel | AK | 0.030 | 0.05 | 3.00 | 0.006 | 0.0006 | 0.01 | 0.00 | 0.00 | 0.00 | 0.000 |
| | AL | 0.032 | 0.04 | 3.05 | 0.006 | 0.0008 | 0.00 | 0.00 | 0.00 | 0.00 | 0.000 |
| | AM | 0.053 | 0.07 | 3.41 | 0.005 | 0.0007 | 0.03 | 0.03 | 0.38 | 0.00 | 0.000 |
| | AN | 0.055 | 0.07 | 3.48 | 0.008 | 0.0009 | 0.03 | 0.03 | 0.47 | 0.00 | 0.000 |
| | AO | 0.030 | 0.08 | 3.15 | 0.009 | 0.0008 | 0.00 | 0.01 | 0.93 | 0.00 | 0.000 |
| | AP | 0.054 | 0.08 | 3.46 | 0.005 | 0.0009 | 0.22 | 0.01 | 0.60 | 0.00 | 0.000 |
| | AQ | 0.032 | 0.08 | 3.34 | 0.006 | 0.0005 | 0.00 | 0.01 | 0.00 | 0.21 | 0.000 |
| | AR | 0.030 | 0.35 | 3.06 | 0.008 | 0.0007 | 0.00 | 0.01 | 0.00 | 0.35 | 0.000 |
| | AS | 0.037 | 0.05 | 3.05 | 0.005 | 0.0008 | 0.00 | 0.00 | 0.00 | 0.52 | 0.000 |

| | Steel | Chemical Composition (mass %) | | | | | | | Index | |
|---|---|---|---|---|---|---|---|---|---|---|
| | | V | Ti | Al | B | Mg | Ca | N | Pcm* | DI** |
| Comparative Steel | AK | 0.001 | 0.000 | 0.055 | 0.0000 | 0.0000 | 0.0000 | 0.0043 | 0.182 | 0.80 |
| | AL | 0.001 | 0.000 | 0.085 | 0.0000 | 0.0023 | 0.0000 | 0.0038 | 0.186 | 0.87 |
| | AM | 0.001 | 0.000 | 0.029 | 0.0000 | 0.0000 | 0.0000 | 0.0043 | 0.247 | 2.14 |
| | AN | 0.001 | 0.000 | 0.045 | 0.0000 | 0.0000 | 0.0000 | 0.0043 | 0.257 | 2.53 |
| | AO | 0.000 | 0.000 | 0.085 | 0.0003 | 0.0000 | 0.0000 | 0.0055 | 0.238 | 2.68 |
| | AP | 0.000 | 0.000 | 0.085 | 0.0003 | 0.0000 | 0.0000 | 0.0035 | 0.272 | 3.22 |
| | AQ | 0.057 | 0.000 | 0.043 | 0.0013 | 0.0000 | 0.0000 | 0.0058 | 0.228 | 1.63 |
| | AR | 0.037 | 0.000 | 0.085 | 0.0025 | 0.0000 | 0.0000 | 0.0055 | 0.234 | 2.23 |
| | AS | 0.000 | 0.015 | 0.031 | 0.0020 | 0.0027 | 0.0026 | 0.0030 | 0.236 | 2.20 |

*Pcm = C + Si/30 + Mn/20 + Cu/20 + Ni/60 + Cr/20 + Mo/15 + V/10 + 5B

**DI = $0.367(C)^{1/2}(1 + 0.7Si)(1 + 3.33Mn)(1 + 0.35Cu)(1 + 0.36Ni)(1 + 2.16Cr)(1 + 3.0Mo)(1 + 1.75V)(1 + 1.77Al)$

TABLE 4

| | Manufacturing Condition No. | Steel | Heating Temperature in Rolling (° C.) | Slab Thickness (mm) | Cumulative Draft at 850° C. or Higher (%) | Cumulative Draft at 780 to 830° C. (%) | Rolling Completion Temperature (° C.) | Cooling Start Temperature (° C.) | Cooling Rate (° C./sec) |
|---|---|---|---|---|---|---|---|---|---|
| Examples | 1 | A | 1040 | 140 | 90 | 12 | 780 | 700 | 80 |
| | 2 | A | 1040 | 140 | 86 | 40 | 780 | 720 | 45 |
| | 3 | B | 990 | 140 | 87 | 11 | 780 | 740 | 25 |
| | 4 | B | 1060 | 140 | 81 | 38 | 790 | 787 | 49 |
| | 5 | C | 1080 | 230 | 89 | 20 | 810 | 781 | 37 |
| | 6 | D | 1060 | 240 | 83 | 25 | 790 | 785 | 11 |
| | 7 | E | 950 | 170 | 70 | 22 | 810 | 751 | 15 |
| | 8 | E | 1040 | 240 | 75 | 33 | 810 | 787 | 14 |
| | 9 | E | 1020 | 310 | 84 | 20 | 790 | 757 | 15 |
| | 10 | F | 1040 | 310 | 84 | 20 | 810 | 752 | 10 |
| | 11 | G | 1050 | 310 | 84 | 20 | 810 | 775 | 8 |
| | 12 | F | 1000 | 240 | 79 | 30 | 800 | 757 | 16 |
| | 13 | G | 1060 | 240 | 77 | 36 | 810 | 779 | 10 |
| | 14 | H | 1080 | 240 | 79 | 40 | 810 | 825 | 22 |
| | 15 | I | 1060 | 240 | 79 | 40 | 810 | 785 | 11 |
| | 16 | A | 1040 | 230 | 87 | 17 | 790 | 725 | 27 |
| | 17 | J | 1030 | 230 | 88 | 11 | 800 | 745 | 27 |
| | 18 | K | 1030 | 230 | 83 | 38 | 810 | 796 | 27 |
| | 19 | L | 1100 | 230 | 87 | 17 | 800 | 752 | 27 |
| | 20 | M | 1030 | 230 | 83 | 38 | 810 | 763 | 27 |
| | 21 | N | 1050 | 240 | 79 | 40 | 800 | 745 | 22 |

| | Manufacturing Condition No. | Cooling Stop Temperature (° C.) | Thickness (mm) | Base Material Yield Stress (MPa) | | Base Material Tensile Strength (MPa) | | Base Material Toughness vE-80 (J) | Required Preheating Temperature (° C.) | Toughness of Weld Heat-Affected Zone vE-50 (J) |
|---|---|---|---|---|---|---|---|---|---|---|
| | | | | ¼t | ½t | ¼t | ½t | | | |
| Examples | 1 | 320 | 12 | 765 | | 922 | | 189 | Preheating is not required | 146 |
| | 2 | 340 | 12 | 729 | | 855 | | 197 | Preheating is not required | 140 |
| | 3 | 80 | 16 | 726 | | 908 | | 179 | Preheating is not required | 163 |
| | 4 | 320 | 16 | 770 | | 919 | | 190 | Preheating is not required | 161 |
| | 5 | 330 | 20 | 789 | | 932 | | 150 | 25 | 181 |
| | 6 | 170 | 30 | 754 | 731 | 950 | 931 | 186 | Preheating is not required | 141 |
| | 7 | 20 | 40 | 750 | 726 | 993 | 974 | 181 | Preheating is not required | 131 |
| | 8 | 20 | 40 | 764 | 731 | 990 | 963 | 181 | Preheating is not required | 169 |

TABLE 4-continued

| | | | | | | | | | |
|---|---|---|---|---|---|---|---|---|---|
| 9 | 150 | 40 | 767 | 745 | 995 | 988 | 181 | Preheating is not required | 166 |
| 10 | 180 | 40 | 780 | 753 | 951 | 924 | 186 | Preheating is not required | 145 |
| 11 | 100 | 40 | 778 | 746 | 992 | 973 | 181 | Preheating is not required | 165 |
| 12 | 320 | 35 | 788 | 762 | 961 | 940 | 185 | Preheating is not required | 140 |
| 13 | 350 | 35 | 749 | 729 | 891 | 871 | 193 | Preheating is not required | 186 |
| 14 | 150 | 30 | 779 | 757 | 957 | 938 | 185 | Preheating is not required | 117 |
| 15 | 20 | 30 | 760 | 722 | 997 | 964 | 180 | Preheating is not required | 125 |
| 16 | 250 | 25 | 756 | 735 | 913 | 886 | 215 | Preheating is not required | 155 |
| 17 | 340 | 25 | 806 | 785 | 956 | 942 | 152 | 25 | 145 |
| 18 | 280 | 25 | 786 | 766 | 995 | 994 | 143 | 25 | 159 |
| 19 | 330 | 25 | 810 | 773 | 954 | 916 | 186 | Preheating is not required | 116 |
| 20 | 300 | 25 | 799 | 759 | 968 | 931 | 184 | Preheating is not required | 163 |
| 21 | 250 | 30 | 772 | 735 | 947 | 898 | 165 | Preheating is not required | 120 |

TABLE 5

| | Manufacturing Condition No. | Steel | Heating Temperature in Rolling (° C.) | Slab Thickness (mm) | Cumulative Draft at 850° C. or Higher (%) | Cumulative Draft at 780 to 830° C. (%) | Rolling Completion Temperature (° C.) | Cooling Start Temperature (° C.) | Cooling Rate (° C./sec) |
|---|---|---|---|---|---|---|---|---|---|
| Examples | 22 | O | 970 | 240 | 83 | 25 | 798 | 755 | 12 |
| | 23 | P | 1030 | 240 | 83 | 25 | 796 | 748 | 20 |
| | 24 | Q | 1040 | 240 | 83 | 25 | 813 | 766 | 20 |
| | 25 | R | 960 | 310 | 85 | 33 | 801 | 762 | 20 |
| | 26 | S | 960 | 310 | 85 | 33 | 790 | 755 | 15 |
| | 27 | T | 1060 | 310 | 84 | 40 | 798 | 752 | 15 |
| | 28 | U | 950 | 310 | 87 | 13 | 808 | 758 | 17 |
| | 29 | V | 1040 | 310 | 87 | 13 | 805 | 768 | 17 |
| | 30 | W | 1020 | 310 | 84 | 20 | 800 | 759 | 14 |
| | 31 | X | 1050 | 310 | 84 | 20 | 793 | 753 | 14 |
| | 32 | Y | 1040 | 230 | 79 | 38 | 780 | 755 | 12 |
| | 33 | Z | 1080 | 230 | 79 | 38 | 790 | 776 | 15 |
| | 34 | AA | 970 | 230 | 79 | 38 | 799 | 759 | 19 |
| | 35 | AB | 980 | 230 | 85 | 14 | 798 | 764 | 18 |
| | 36 | AC | 1030 | 230 | 85 | 14 | 792 | 746 | 15 |
| | 37 | AD | 1030 | 230 | 83 | 25 | 802 | 754 | 15 |
| | 38 | AE | 1040 | 230 | 83 | 25 | 812 | 776 | 17 |
| | 39 | AF | 960 | 230 | 80 | 33 | 791 | 745 | 19 |
| | 40 | AG | 960 | 230 | 85 | 29 | 793 | 745 | 25 |
| | 41 | AH | 970 | 230 | 87 | 17 | 797 | 740 | 25 |
| | 42 | AI | 1050 | 230 | 87 | 17 | 800 | 743 | 28 |
| | 43 | AJ | 1070 | 230 | 88 | 11 | 817 | 759 | 25 |

| | Manufacturing Condition No. | Cooling Stop Temperature (° C.) | Thickness (mm) | Base Material Yield Stress (MPa) ¼t | Base Material Yield Stress (MPa) ½t | Base Material Tensile Strength (MPa) ¼t | Base Material Tensile Strength (MPa) ½t | Base Material Toughness vE-80 (J) | Required Preheating Temperature (° C.) | Toughness of Weld Heat-Affected Zone vE-50 (J) |
|---|---|---|---|---|---|---|---|---|---|---|
| Examples | 22 | 20 | 30 | 624 | 593 | 755 | 735 | 172 | Preheating is not required | 39 |
| | 23 | 200 | 30 | 752 | 734 | 926 | 915 | 163 | 50 | 35 |
| | 24 | 60 | 30 | 753 | 737 | 979 | 979 | 167 | 25 | 52 |
| | 25 | 150 | 30 | 630 | 611 | 765 | 753 | 153 | Preheating is not required | 154 |
| | 26 | 350 | 30 | 763 | 741 | 886 | 874 | 73 | Preheating is not required | 137 |
| | 27 | 180 | 30 | 763 | 745 | 944 | 942 | 49 | Preheating is not required | 22 |
| | 28 | 290 | 35 | 760 | 733 | 918 | 894 | 79 | Preheating is not required | 34 |
| | 29 | 250 | 35 | 767 | 739 | 936 | 910 | 81 | Preheating is not required | 162 |
| | 30 | 290 | 40 | 747 | 730 | 896 | 877 | 189 | Preheating is not required | 27 |
| | 31 | 240 | 40 | 760 | 737 | 925 | 893 | 177 | Preheating is not required | 30 |
| | 32 | 330 | 30 | 652 | 633 | 776 | 778 | 82 | Preheating is not required | 139 |
| | 33 | 320 | 30 | 643 | 630 | 756 | 762 | 83 | Preheating is not required | 150 |
| | 34 | 190 | 30 | 766 | 750 | 958 | 948 | 177 | Preheating is not required | 35 |
| | 35 | 320 | 30 | 761 | 740 | 900 | 888 | 157 | Preheating is not required | 36 |
| | 36 | 260 | 30 | 772 | 745 | 929 | 910 | 69 | Preheating is not required | 26 |
| | 37 | 150 | 30 | 778 | 757 | 973 | 971 | 68 | Preheating is not required | 38 |
| | 38 | 240 | 30 | 763 | 739 | 929 | 911 | 46 | Preheating is not required | 32 |
| | 39 | 350 | 30 | 766 | 749 | 892 | 883 | 180 | Preheating is not required | 38 |
| | 40 | 280 | 25 | 771 | 744 | 920 | 900 | 169 | Preheating is not required | 24 |
| | 41 | 200 | 25 | 769 | 750 | 951 | 946 | 49 | Preheating is not required | 42 |
| | 42 | 340 | 25 | 774 | 755 | 897 | 890 | 51 | Preheating is not required | 28 |
| | 43 | 270 | 25 | 764 | 739 | 919 | 911 | 78 | Preheating is not required | 31 |

TABLE 6

| | Manufacturing Condition No. | Steel | Heating Temperature in Rolling (° C.) | Slab Thickness (mm) | Cumulative Draft at 850° C. or Higher (%) | Cumulative Draft at 780 to 830° C. (%) | Rolling Completion Temperature (° C.) | Cooling Start Temperature (° C.) | Cooling Rate (° C./sec) |
|---|---|---|---|---|---|---|---|---|---|
| Examples | 44 | AK | 960 | 230 | 85 | 14 | 815 | 788 | 19 |
| | 45 | AL | 1060 | 230 | 78 | 20 | 809 | 784 | 17 |
| | 46 | AM | 990 | 230 | 74 | 33 | 810 | 771 | 19 |
| | 47 | AN | 1070 | 230 | 76 | 29 | 820 | 794 | 16 |
| | 48 | AO | 1060 | 230 | 74 | 33 | 791 | 754 | 16 |
| | 49 | AP | 960 | 230 | 72 | 38 | 813 | 791 | 16 |
| | 50 | AQ | 1010 | 230 | 74 | 33 | 805 | 774 | 19 |
| | 51 | AR | 1060 | 230 | 78 | 20 | 817 | 786 | 16 |
| | 52 | AS | 1060 | 230 | 74 | 33 | 802 | 764 | 19 |

| | Manufacturing Condition No. | Cooling Stop Temperature (° C.) | Thickness (mm) | Base Material Yield Stress (MPa) ¼t | Base Material Yield Stress (MPa) ½t | Base Material Tensile Strength (MPa) ¼t | Base Material Tensile Strength (MPa) ½t | Base Material Toughness vE-80 (J) | Required Preheating Temperature (° C.) | Toughness of Weld Heat-Affected Zone vE-50 (J) |
|---|---|---|---|---|---|---|---|---|---|---|
| Examples | 44 | 140 | 30 | 659 | 640 | 889 | 870 | 85 | Preheating is not required | 45 |
| | 45 | 270 | 40 | 666 | 652 | 790 | 775 | 78 | Preheating is not required | 37 |
| | 46 | 320 | 40 | 713 | 695 | 847 | 830 | 167 | 50 | 152 |
| | 47 | 350 | 40 | 731 | 716 | 858 | 834 | 175 | 75 | 137 |
| | 48 | 150 | 40 | 741 | 724 | 918 | 888 | 156 | Preheating is not required | 23 |
| | 49 | 100 | 40 | 770 | 750 | 971 | 950 | 125 | 75 | 34 |
| | 50 | 20 | 40 | 768 | 747 | 986 | 967 | 148 | 25 | 32 |
| | 51 | 80 | 40 | 763 | 747 | 956 | 937 | 173 | 25 | 27 |
| | 52 | 270 | 40 | 753 | 734 | 926 | 895 | 160 | 25 | 29 |

TABLE 7

| | Manufacturing Condition No. | Steel | Heating Temperature in Rolling (° C.) | Slab Thickness (mm) | Cumulative Draft at 850° C. or Higher (%) | Cumulative Draft at 780 to 830° C. (%) | Rolling Completion Temperature (° C.) | Cooling Start Temperature (° C.) | Cooling Rate (° C./sec) |
|---|---|---|---|---|---|---|---|---|---|
| Examples | 53 | J | 1130 | 240 | 79 | 20 | 805 | 781 | 17 |
| | 54 | C | 1180 | 240 | 79 | 20 | 813 | 789 | 17 |
| | 55 | A | 1130 | 170 | 60 | 41 | 792 | 760 | 12 |
| | 56 | B | 1090 | 170 | 66 | 31 | 805 | 775 | 12 |
| | 57 | B | 1060 | 240 | 82 | 7 | 820 | 798 | 14 |
| | 58 | C | 1000 | 240 | 82 | 9 | 799 | 777 | 17 |
| | 59 | D | 1050 | 310 | 77 | 43 | 793 | 756 | 14 |
| | 60 | E | 970 | 310 | 74 | 50 | 807 | 767 | 16 |
| | 61 | B | 1060 | 310 | 84 | 20 | 743 | 768 | 10 |
| | 62 | E | 960 | 310 | 84 | 20 | 770 | 775 | 10 |
| | 63 | C | 1080 | 310 | 84 | 20 | 798 | 657 | 14 |
| | 64 | F | 980 | 310 | 84 | 20 | 819 | 685 | 12 |
| | 65 | D | 1080 | 240 | 79 | 30 | 805 | 746 | 5 |
| | 66 | G | 980 | 240 | 79 | 30 | 803 | 750 | 7 |
| | 67 | H | 1090 | 240 | 79 | 30 | 815 | 799 | 16 |
| | 68 | H | 980 | 240 | 79 | 30 | 816 | 790 | 16 |
| | 69 | A | 990 | 140 | 88 | 29 | 762 | 710 | 40 |
| | 70 | I | 1080 | 140 | 88 | 29 | 799 | 650 | 42 |
| | 71 | J | 1080 | 140 | 89 | 25 | 801 | 740 | 7 |
| | 72 | K | 1050 | 140 | 90 | 14 | 792 | 735 | 40 |
| | 73 | L | 1020 | 140 | 90 | 14 | 797 | 724 | 45 |

| | Manufacturing Condition No. | Cooling Stop Temperature (° C.) | Thickness (mm) | Base Material Yield Stress (MPa) ¼t | Base Material Yield Stress (MPa) ½t | Base Material Tensile Strength (MPa) ¼t | Base Material Tensile Strength (MPa) ½t | Base Material Toughness vE-80 (J) | Required Preheating Temperature (° C.) | Toughness of Weld Heat-Affected Zone vE-50 (J) |
|---|---|---|---|---|---|---|---|---|---|---|
| Examples | 53 | 20 | 40 | 763 | 726 | 987 | 967 | 48 | Preheating is not required | 136 |
| | 54 | 90 | 40 | 776 | 742 | 984 | 964 | 49 | Preheating is not required | 173 |
| | 55 | 150 | 40 | 618 | 589 | 768 | 746 | 58 | Preheating is not required | 133 |

TABLE 7-continued

| | | | | | | | | | |
|---|---|---|---|---|---|---|---|---|---|
| 56 | 340 | 40 | 651 | 629 | 752 | 742 | 57 | Preheating is not required | 154 |
| 57 | 150 | 40 | 616 | 590 | 758 | 748 | 129 | Preheating is not required | 149 |
| 58 | 320 | 40 | 631 | 594 | 738 | 707 | 134 | 25 | 139 |
| 59 | 130 | 40 | 628 | 593 | 783 | 756 | 57 | Preheating is not required | 155 |
| 60 | 80 | 40 | 650 | 627 | 828 | 815 | 62 | Preheating is not required | 141 |
| 61 | 50 | 40 | 648 | 622 | 834 | 825 | 85 | Preheating is not required | 157 |
| 62 | 50 | 40 | 604 | 578 | 763 | 751 | 65 | Preheating is not required | 177 |
| 63 | 310 | 40 | 613 | 582 | 719 | 695 | 53 | 25 | 178 |
| 64 | 290 | 40 | 644 | 618 | 755 | 744 | 59 | Preheating is not required | 180 |
| 65 | 90 | 35 | 657 | 627 | 827 | 813 | 62 | Preheating is not required | 158 |
| 66 | 300 | 35 | 628 | 604 | 737 | 725 | 68 | Preheating is not required | 175 |
| 67 | 380 | 35 | 602 | 571 | 740 | 718 | 49 | Preheating is not required | 144 |
| 68 | 400 | 35 | 595 | 573 | 697 | 690 | 46 | Preheating is not required | 140 |
| 69 | 300 | 12 | 596 | | 715 | | 78 | Preheating is not required | 142 |
| 70 | 250 | 12 | 589 | | 717 | | 75 | Preheating is not required | 143 |
| 71 | 200 | 12 | 627 | | 770 | | 85 | 25 | 174 |
| 72 | 380 | 12 | 625 | | 786 | | 74 | 25 | 155 |
| 73 | 520 | 12 | 587 | | 749 | | 82 | Preheating is not required | 184 |

Tables 4-7 show the results of evaluations of the base material strength (base material yield stress, base material tensile strength), the base material toughness, the weldability (required preheating temperature) and the low-temperature toughness of a welded joint (weld heat-affected zone) of steel plates.

Regarding the base material strength, 1 A—full thickness tensile test pieces or 4-round bar tensile test pieces specified in JIS Z 2201 were collected to measure the base material strength by a method specified in JIS Z 2241. In the case of plates having a thickness of 20 mm or less, 1 A—full thickness tensile test pieces were collected, and in the case of plates having a thickness of more than 20 mm, 4-round bar tensile test pieces were collected from the ¼ parts (¼t parts) of a plate thickness and a thickness center portion (½t parts).

Regarding the base material toughness, impact test pieces specified in JIS Z 2202 were collected in a direction perpendicular to the rolling direction from the thickness center portion, and the Charpy absorbed energy (vE-80) at −80° C. was obtained by a method specified in JIS Z 2242 to evaluate the base material toughness.

Regarding the weldability, shielded metal arc welding was performed at between 14-16° C. at a heat input of 1.7 kJ/mm by a method specified in JIS Z 3158 and a preheating temperature required to prevent root cracks was thus obtained to evaluate the weldability.

Regarding the toughness of the weld heat-affected zone, SAW welding (current 500 A, voltage 30 V, rate 30 cm/min) was performed at a heat input amount of 3.0 kJ/mm by using a V-shaped groove of an angle of 20° having a root gap and impact test pieces specified in JIS Z 2202 were collected from a thickness center portion (½t parts) so that a notch bottom includes a fusion line as large as possible, and then, the toughness of the weld heat-affected zone was evaluated with absorbed energy (vE-50) at −50° C.

As for the target values of the features, the base material yield stress was 685 Mpa or more, the base material tensile strength was 780 Mpa or more, the base material toughness (vE-80) was 100 J or more, the required preheating temperature was 25° C. or less, and the toughness of the weld heat-affected zone was 60 J or more with vE-50.

All the examples 1-21 according to the present invention have a base material yield stress of 685 Mpa or more, a base material tensile strength of 780 Mpa or more, a base material toughness (vE-80) of 100 J or more, a required preheating temperature of 25° C. or more, and weld heat-affected zone toughness of 60 J or more with vE-50.

On the other hand, the following comparative examples have insufficient base material yield stress and tensile strength. That is, the base material yield stress and the tensile strength are insufficient due to a small additional amount of C in the case of the comparative example 22, a small additional amount of Mn in the case of the comparative example 25, the addition of Nb in the case of the comparative examples 32 and 33, a low Pcm value in the case of the comparative examples 44 and 45, a cumulative draft less than 70% at 850° C. or higher in the case of the comparative examples 55 and 56, a cumulative draft less than 10% at 780-830° C. in the case of the comparative examples 57 and 58, a cumulative draft more than 40% at 780-830° C. in the case of the comparative examples 59 and 60, a rolling completion temperature lower than 780° C. in the case of the comparative examples 61, 62 and 69, a water cooling start temperature lower than 700° C. in the case of the comparative examples 63, 64 and 70, a cooling rate less than 8° C./sec in the case of the comparative examples 65, 66 and 71, and a cooling stop temperature higher than 350° C. in the case of the comparative examples 67, 68, 72 and 73.

The following comparative examples have insufficient base material toughness. The base material toughness is insufficient due to a large additional amount of Mn in the case of the comparative example 26, a large additional amount of P in the case of the comparative example 27, a large additional amount of S in the case of the comparative example 28, a large additional amount of Cr in the case of the comparative example 29, the addition of Nb in the case of the comparative examples 32 and 33, the addition of Ti in the case of the comparative examples 36 and 37, a large additional amount of Al in the case of the comparative example 38, large additional amounts of Mg, Ca and N in the case of the comparative examples 41, 42 and 43, respectively, a low Pcm value in the case of the comparative examples 44 and 45, a high heating temperature in the case of the comparative examples 53 and 54, a cumulative draft less than 70% at 850° C. or higher in the case of the comparative examples 55 and 56, a cumulative draft more than 40% at 780-830° C. in the case of the comparative examples 59 and 60, a rolling completion temperature lower than 780° C. in the case of the comparative examples 61, 62 and 69, a water cooling start temperature lower than 700° C. in the case of the comparative examples 63, 64 and 70, a cooling rate less than 8° C./sec in the case of the comparative examples 65, 66 and 71, and a cooling stop temperature higher than 350° C. in the case of the comparative examples 67, 68, 72 and 73.

Due to a large additional amount of C in the case of the comparative example 23 and a high Pcm value in the case of the comparative examples 46, 47 and 49, the required preheating temperature is higher than 25° C. and thus the preheating-free requirement is not satisfied.

In addition, the following comparative examples do not satisfy the low-temperature toughness of a welded joint requirement (weld heat-affected zone toughness). That is, none of the following comparative examples satisfy the low-temperature toughness of the welded joint requirement due to a small additional amount of C in the case of the comparative example 22, a large additional amount of C in the case of the comparative example 23, the addition of Si in the case of the comparative example 24, large additional amounts of P and S in the case of the comparative examples 27 and 28, respectively, the addition of Mo in the case of the comparative examples 30 and 31, the addition of V in the case of the comparative examples 34 and 35, the addition of Ti in the case of the comparative examples 36 and 37, a large additional amount of Al in the case of the comparative example 38, the addition of B in the case of the comparative examples 39 and 40, large additional amounts of Mg, Ca and N in the case of the comparative examples 41, 42 and 43, respectively, a low DI value in the case of the comparative examples 44 and 45, a high DI value in the case of the comparative examples 48 and 49, the addition of three or four of Mo, V, Si, Ti and B in the case of the comparative examples 50, 51 and 52. In the case of the comparative example 49, since more than 0.20% of Cu was added to the steel in which Ni was not added, fine cracks were generated in the steel slab surface. Accordingly, it was necessary to partially grind the surface by several millimeters before hot rolling and productivity was thus reduced.

INDUSTRIAL APPLICABILITY

According to the invention, a high tensile strength thick steel plate with a tensile strength of 780 MPa or more and a thickness of 12-40 mm, which is suitable as a structural member for welding structures such as construction machines, industrial machines, bridges, buildings, ships and the like strongly requiring high strength, and which has excellent preheating-free weldability, can be manufactured with high productivity and at a low cost without using expensive Ni and requiring a reheating tempering heat treatment after rolling. The effect thereof on the industrial field is very significant.

The invention claimed is:

1. A method of manufacturing a high tensile strength thick steel plate having high weldability and low-temperature toughness of a welded joint, with a tensile strength of 780 MPa or more and a yield stress of 685 MPa or more, the steel plate having a thickness of 12-40 mm, the method comprising:

heating to 950-1100° C. a steel slab or a cast slab having a component composition which includes, in mass %, 0.030-0.055% of C, 3.0-3.5% of Mn, and 0.002-0.10% of Al, and restricts P to 0.01% or less, S to 0.0010% or less, N to 0.0060% or less, Mo to 0.03% or less, Si to 0.09% or less, V to 0.01% or less, Ti to 0.003% or less, B to 0.0003% or less, Nb to 0.003% or less, and Ni to 0.03% or less, wherein a Pcm value representing a weld cracking parameter is within a range of 0.20-0.24% and a DI value representing a hardenability index is within a range of 1.00-2.60, and comprises a balance of Fe with inevitable impurities;

performing a first rolling with a cumulative draft of 70-90% at a temperature of 850° C. or more, thereafter performing a second rolling with a cumulative draft of 10-40% at a temperature in a range of 780-830° C.; and subsequently starting accelerated cooling at a cooling rate of 8-80° C./sec from 700° C. or higher, and stopping the accelerated cooling at a temperature between room temperature and 350° C., wherein $$Pcm=[C]+[Si]/30+[Mn]/20+[Cu]/20+[Ni]/60+[Cr]/20+[Mo]/15+[V]/10+5[B],$$

$$DI=0.367([C]^{1/2})(1+0.7[Si])(1+3.33[Mn])(1+0.35[Cu])(1+0.36[Ni])(1+2.16[Cr])(1+3.0[Mo])(1+1.75[V])(1+1.77[Al]),$$

where [C], [Si], [Mn], [Cu], [Ni], [Cr], [Mo], [V], [Al], and [B] are the amounts, expressed in mass %, of C, Si, Mn, Cu, Ni, Cr, Mo, V, Al and B respectively.

2. The method of manufacturing a high tensile strength thick steel plate according to claim 1, said steel slab or cast slab further containing, one or more of: 0.05-0.20% of Cu, 0.05-1.00% of Cr, 0.0005-0.01% of Mg, and 0.0005-0.01% of Ca, in mass %.

3. The method of manufacturing a high tensile strength thick steel plate according to claim 1, wherein said welded joint is subjected to submerged arc welding at a welding heat input of 3.0 kJ/mm, and wherein a Charpy absorbed energy of a weld heat-affected zone of the welded joint is 60 J or more at −50° C.

4. The method of manufacturing a high tensile strength thick steel plate according to claim 2, wherein said welded joint is subjected to submerged arc welding at a welding heat input of 3.0 kJ/mm, and wherein a Charpy absorbed energy of a weld heat-affected zone of the welded joint is 60 J or more at −50° C.

5. The method of manufacturing a high tensile strength thick steel plate according to claim 1, wherein said thick steel plate does not need preheating.

6. The method of manufacturing a high tensile strength thick steel plate according to claim 2, wherein said thick steel plate does not need preheating.

7. The method of manufacturing a high tensile strength thick steel plate according to claim 1, further comprising producing said steel slab or a cast slab.

8. The method of manufacturing a high tensile strength thick steel plate according to claim 2, further comprising producing said steel slab or a cast slab.

9. The method of manufacturing a high tensile strength thick steel plate according to claim 1, wherein reheating tempering heat treatment after rolling and/or cooling is omitted.

10. The method of manufacturing a high tensile strength thick steel plate according to claim 2, wherein reheating tempering heat treatment after rolling and/or cooling is omitted.

* * * * *